United States Patent [19]

Gallet

[11] Patent Number: 4,979,762

[45] Date of Patent: Dec. 25, 1990

[54] SKI BOOT SAFETY BINDING

[75] Inventor: Yvon Gallet, Alby sur Cheran, France

[73] Assignee: Salomon S.A., Annecy Cedex, France

[21] Appl. No.: 293,087

[22] Filed: Jan. 3, 1989

[30] Foreign Application Priority Data

Jan. 5, 1988 [FR] France ..... 88 00037

[51] Int. Cl.[5] ..... A63C 9/085

[52] U.S. Cl. ..... 280/625; 280/628; 280/634

[58] Field of Search ..... 280/625, 626, 628, 629, 280/634, 618

[56] References Cited

U.S. PATENT DOCUMENTS

| | | | |
|---|---|---|---|
| 3,348,854 | 10/1967 | Marker et al. | 280/634 |
| 3,490,781 | 1/1970 | Marker | 280/625 |
| 3,572,738 | 3/1971 | Martin | 280/625 |
| 3,638,959 | 2/1972 | Reuge | 280/625 |
| 3,806,143 | 4/1974 | Wyss | 280/625 |
| 3,854,741 | 12/1974 | Marker et al. | 280/625 |
| 4,365,822 | 12/1982 | Nitschko et al. | 280/625 |
| 4,494,769 | 1/1985 | Beyl et al. | 280/625 |
| 4,660,849 | 4/1987 | Sedlmair et al. | 280/625 |
| 4,684,147 | 8/1987 | Pascal et al. | 280/625 |
| 4,685,696 | 8/1987 | Sedlmair et al. | 280/625 |
| 4,728,117 | 3/1988 | Stepanek | 280/625 |
| 4,735,434 | 4/1988 | Sedlmair | 280/625 |
| 4,784,404 | 11/1988 | Kowatsch | 280/634 |

FOREIGN PATENT DOCUMENTS

| | | | |
|---|---|---|---|
| 68921 | 1/1983 | European Pat. Off. . | |
| 2156342 | 5/1973 | France . | |
| 2190488 | 2/1974 | France | 280/625 |
| 2543445 | 10/1984 | France . | |

*Primary Examiner*—David M. Mitchell

*Attorney, Agent, or Firm*—Sandler, Greenblum Bernstein

[57] ABSTRACT

A ski binding for retaining an end of a boot on a ski, including a body preferably mounted for pivoting vertically with respect to the ski, a jaw having a pair of arms arranged for lateral movement and elastic bias relative to the body and, further, having a pair of lateral wings arranged for lateral movement on respective lateral arms. Upon movement of one of the lateral arms of the jaw a predetermined amount in response to a lateral force exerted by the boot against a respective wing of a lateral arm, the wing is caused to move laterally outwardly from its lateral arm to release the boot. Further, upon a certain amount of lateral movement of an arm, upward movement of the body is used to reduce the lateral release threshold of the binding.

35 Claims, 6 Drawing Sheets

3
8
19c
26
25
27a
32
33
18
24
28
19a
19
1
16a
13
13a
23
11
12
21
9
19b
x
9a
16
y 1
2
4
5
5a
6
7
8
9
9a
11
12
13
13a
14
15
16
17
23
24
25
26
26a
26b
27
27a
27b
27c
28
28a
28b
29
32

1
2
4
5
5a
6
7
8
8b
8c
9
9a
11
12
13
13a
14
15
16
16a
17
23
24
25
27
27a
27b
27c
28
28a
29
F

SKI BOOT SAFETY BINDING

BACKGROUND OF THE INVENTION

1. Field of the Invention

The present invention relates to a ski safety binding adapted to releasably maintain the front of a boot mounted on the ski.

2. Description of Background and Relevant Information

Safety bindings for skis, particularly front bindings, include a body mounted on a base affixed to the ski. The body of the binding has, at its rear portion, a retention jaw for engagement with the boot. The jaw includes two lateral opposed retention wings and an energization mechanism positioned within the body to elastically return the jaw to the engagement position with the boot. The energization mechanism includes a compressed energy spring which is supported at one end by a support surface connected to the body and, at its other end, on a force transmission element which is longitudinally movable in the body and coupled to the jaw in a manner so as to elastically bias the jaw against the front of the boot to ensure the retention of the boot on the ski.

Front bindings of the above type are described, for example, in French Pat. No. 2,190,488. The binding described therein includes a retention jaw which is constituted by two lateral retention wings which respectively form an integral portion with the posterior portions of two L-shaped arms which act as levers. Each of the arms is journalled on the body of the binding, at its front portion, substantially at the apex of the L, around a vertical axis. Each arm further includes a major longitudinal arm segment extending towards the rear, and at the end of which is formed one of the retention wings and, at the front, a minor transverse arm segment extending toward the longitudinal axis of the binding. A force transmission element, such as a piston, acts on the minor arm segment and is pushed frontwardly by the energy spring, which forms a portion of the energization by the energy mechanism. Consequently, the force exerted by the energy spring on the minor arm segments of the two L-shaped arms tends to pivot the longitudinal arm segments of the L-shaped arms in the direction of the longitudinal axis of the binding. This presses the lateral retention wings, which are an integral portion of the L-shaped arm, against the edge of the sole. The lateral retention wings are likewise shaped in a manner so as to ensure the vertical retention of the boot. Furthermore, in such a front binding the rear edge portion of each arm which is near the longitudinal axis of the binding constitutes a frontal support against which the front of the sole of the boot is maintained in abutment. Facing this frontal support towards the exterior is a support surface of the lateral retention wing in contact with the edge of the sole of the boot.

Such a front binding has a certain number of disadvantages. First, by virtue of the fact that the lateral wing is an integral portion of the L-shaped arm, during lateral release, there is a substantial friction between the edge of the sole and the retention wing because there is a relative sliding of the sole on the wing. Furthermore, with regard to the lateral portion of the boot which causes a lateral release of the front binding, the front of the boot must go around the rear end of the portion of the L-shaped arm, which constitutes the lateral retention wing, before becoming released. Consequently, the boot is retained for a relatively long period in the front binding before being released and its actual release is not very precise.

SUMMARY OF THE INVENTION

It is an object of the present invention to overcome the disadvantages mentioned above by providing a safety binding for releasably retaining the front of a boot mounted on a ski. The binding has a body mounted on a base affixed to the ski, a retention jaw movably affixed relative to a rear portion of the body including a sole-grip and two laterally opposed retention wings. The jaw has an engagement position and an energization mechanism positioned within the body to elastically return the jaw into the engagement position upon movement away from the engagement position. The energization mechanism includes an energy spring supported, at one end, by a support surface connected to the body, a force transmission element which is longitudinally movable within the body, and against which the energy spring is supported at another end of the energy spring, and a coupling apparatus which couples the force transmission element and the wings to elastically bias the wings against the front of the boot to ensure the retention of the boot on the ski. The coupling apparatus between the force transmission element and the wings of the jaw include two substantially L-shaped arms, each arm including a substantially longitudinal major segment extending towards the boot, preferably to the rear of the binding, and which carries a respective one of the two lateral retention wings. In front, or away from the boot, each L-shaped arm includes a substantially transverse minor segment, extending toward the longitudinal axis of the binding. The L-shaped arms are journalled on the body adjacent portions of respective transverse minor segments which are most remote from the longitudinal axis of the binding. The force transmission element is positioned for engagement with respective minor segments to bias the major segment of each arm toward the longitudinal axis of the binding. Each major segment of each L-shaped arm further includes a rear edge which constitutes a frontal support for the front of the sole of the boot, wherein each lateral retention wing is journalled around a portion of the L-shaped arm around a substantially vertical axis. A latching device is operatively associated with each lateral retention wing to normally maintain each lateral retention wing in a closed position with its respective L-shaped arm and frees the wing from the closed position only when the L-shaped arm has pivoted by a predetermined angle away from the longitudinal axis of the binding to release the ski boot by lateral pivoting of the wing relative to its respective L-shaped arm.

According to one aspect of the invention, the frontal support of each of the major segments of the L-shaped arms has a convexity directed towards the boot.

According to another aspect of the invention, the binding includes a substantially horizontal and transverse journal axis around which the body pivots with respect to the base, wherein the journal axis is positioned above the level of the frontal supports for the sole of the boot. Alternatively, the journal axis can be positioned at substantially the same level as the frontal supports for the sole of the boot, or below the level of the frontal supports for the sole of the boot.

Further according to the invention, each of the wings includes, in front of its respective journal axis, a transverse branch which includes an end which extends toward the longitudinal axis, and which carries a roller proximate the end. The base further includes a ramp which is engaged by the rollers, the ramp including sections extending transversely from opposite sides of the longitudinal axis to a curved portion extending towards the rear.

Still further according to the invention, the rollers of the transverse branches of the wings of the jaw are configured and arranged for engagement with respective curved portions of the ramp for movement therealong away from the longitudinal axis in response to a force against a respective one of the wings to cause at least a respective one of the L-shaped arms to pivot away from the longitudinal axis and for movement of a respective one of the wings relative to its respective L-shaped arm for release of the boot from the binding.

A still further aspect of the invention includes means for reducing a lateral release threshold of the binding in response to a combined upward and lateral movement of the boot. This means can take the form of a means for permitting pivoting of the body upwardly about a substantially horizontal and transverse journal axis only in response to a predetermined amount of lateral movement of the boot.

The present invention can be further defined as a binding for retaining an end of a boot upon a ski, the binding having a longitudinal axis and further including a body; means for securing the body to the ski; a retention jaw for engagement with the end of the boot in an engagement position, the retention jaw including a first arm and a second arm; first means for mounting the first arm and second arm on the body on respective sides of the longitudinal axis for lateral movement with respect to the body; a first wing and a second wing; and second means for mounting the first wing and the wing for lateral movement, respectively, on the first arm and on the second arm, the first wing and the second wing having a closed position in which the first wing and the second wing are substantially fixed for movement with the first arm and the second arm, respectively; means for elastically biasing the jaw in the engagement position and the wings in the closed position by exerting an elastic force against the first arm and the second arm of the jaw; and means for permitting movement of each of the first wing and the second wing from its respective closed position relative to the first arm and the second arm, respectively, in response to a predetermined amount of movement of the first arm and second arm, respectively, with respect to the body.

Further according to the invention, each of the first arm and the second arm include (i) a segment extending substantially longitudinally toward the boot from the first mounting means and (ii) a segment extending transversely toward the longitudinal axis from the first mounting means.

Still further according to the invention, the means for permitting movement of each of the wings from its respective closed position includes a guide surface on the body and means affixed to each respective wing for movable engagement with the guide surface. The guide surface of the body includes a ramp extending substantially transversely, the ramp having a curved portion extending toward the boot on either side of the longitudinal axis of the binding, wherein the means affixed to each respective wing includes a transverse branch movable with respect to the ramp, and wherein each wing is movable from its respective closed position in response to movement of its respective transverse branch to a the curved portion of the ramp. Further, each of the transverse branches carries a roller for engagement with the ramp.

The frontal supports according to the invention are configured to provide substantially only longitudinal support for the boot and the first wing and the second wing are configured to provide substantially no longitudinal support for the boot.

Still further according to the invention, the binding includes a first support surface fixed relative to the body and a second support surface movable relative to the body, wherein the elastically biasing means includes an elastic return element positioned between the first support surface and the second support surface for exerting the elastic force against the transverse segments of the first arm and the second arm of the jaw, wherein the second support surface is movable a predetermined amount, in response to the predetermined amount of lateral movement of the first wing of the second wing by the boot, for permitting the pivoting of the body upwardly about the substantially horizontal and transverse pivot axis.

Still further according to the invention, the means for permitting pivoting of the body further includes a guided element fixed with respect to the body and means for guiding the guided element fixed against movement with the guided element, whereby the means for guiding restrains the guided element for movement upwardly with respect to the means for guiding upon movement of either of the first wing and the second wing less than the predetermined amount.

Still further, the guided element is a substantially horizontally and transversely extending pin and the means for guiding includes an element having a pair of laterally spaced ears having slots for engagement with the pin.

Still further, the body is movable upwardly relative to the element, the element adapted to be adjustably affixed to the ski, including means for adjusting the position of the element toward and away from the ski for accommodating various boot sole thicknesses.

BRIEF DESCRIPTION OF THE DRAWINGS

The invention will now be described with reference to certain non-limiting examples of various embodiments of the present invention, with reference to the annexed drawings in which.

DESCRIPTION OF PREFERRED EMBODIMENTS

Figure 1:
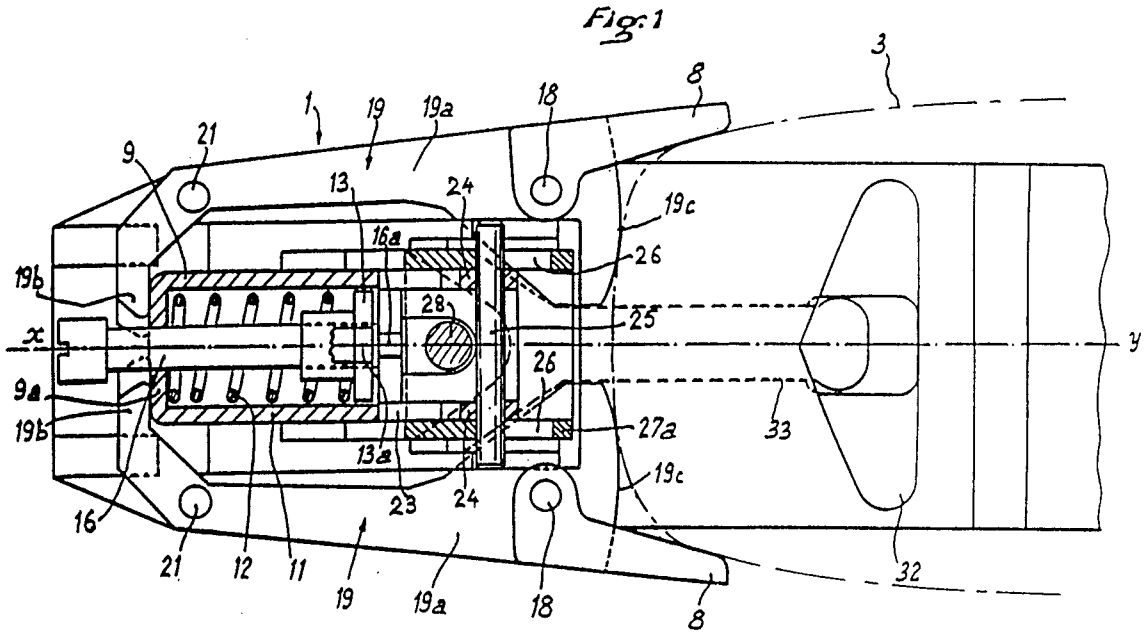
FIG. 1 is a horizontal cross-sectional view of front binding according to the invention, in the engaged position.

The present invention overcomes the disadvantages noted above by providing a front binding which is of particularly simple design, and which has a high sensitivity to release and in which the inherent disadvantage which exists by virtue of the friction of the sole on the wings of the jaws is considerably reduced.

To this end the present invention provides safety binding for a ski adapted to maintain the front of a boot releasably mounted on the ski and includes a body mounted on a base affixed to the ski. The body carries, at its rear portion, a retention jaw for the boot which includes a sole grip and two laterally opposed retention wings, and an energization mechanism positioned in the body to elastically return the jaw to the engaged position. The energization mechanism includes an energy spring supported at one end on a support surface connected to the body and, at its other end, on a longitudinally movable force transmission element located within the body and coupled to the wings of the jaw in a manner so as to elastically bias the wings against the front of the boot to ensure its retention on the ski. The coupling apparatus between the force transmission element and the wings of the jaw include two substantially L-shaped arms journalled on the body at their front portions around vertical axes adjacent to the apex of the L. Each arm includes a major segment which is substantially longitudinal and extends toward the rear and which carries, at its rear end, a lateral retention wing. In front, each arm includes a minor substantially transverse segment extending in the direction of the longitudinal axis of the binding and on which the force transmission element acts in a manner so as to bias the major segment of each arm in the direction of the longitudinal axis of the binding. Each arm ends in a rear edge constituting a frontal support for the front of the sole of the boot and is characterized in that each lateral retention wing is journalled on the rear portion of the L-shaped arm which is associated therewith around a substantially vertical axis. Latching means are provided to normally maintain each lateral retention wing in the closed or engaged position and to free the wing only when the L-shaped arm carrying the journalled wing has pivoted by a predetermined angle towards the exterior in a manner so as to free the boot by lateral pivoting of the wing.

The safety binding according to the invention offers the advantage that, since each lateral retention wing is journalled on the arm which itself ends in a rear edge constituting a frontal support for the sole of the boot, there is no effect of a longitudinal pressure on the lateral bias, nor the inverse. Furthermore, one obtains a rapid release of the boot as soon as the wing pivots.

According to one complementary characteristic of the invention the frontal support is of the enveloping type which results in practically no friction between the support and the front of the sole of the boot when the boot pivots around its heel. It likewise makes it possible to master the engagement or disengagement of the jaw. Preferably, the curvature of the enveloping central support is defined in a manner so as to be neutral, i.e., when the boot pivots around its heel there is neither advancement (disengagement from the binding) nor retreat (engagement of the binding) of the boot.

With reference to FIGS. 1–4, a safety binding 1 is illustrated which is mounted on a ski 2 and which is adapted to retain the front end of the ski boot 3 shown in dashed lines. This safety binding, or "front abutment binding", includes a base 4 affixed to the ski by screws or other means, and on which is mounted a body 5 which can pivot on base 4 at its front portion around a substantially horizontal and transverse axis 6. Body 5 includes, at its rear portion, a retention jaw 7 which includes two wings 8 for lateral and vertical retention of the boot.

The energization mechanism of the front binding 1 includes a force transmission element constituted by a tubular piston 9 which extends and slides in a longitudinal bore 11 of body 5. In the tubular piston 9 a compression spring 12 is positioned and which is supported, at its front end, on the end **9*a* of piston 9. At its rear end the compression spring 12 is supported on a rounded element 13 bored with a tapped axial hole 14 at its center. This tapped hole is engaged on the extreme threaded portion 15 of an axial shaft 16 which traverses the end 9*a* of piston 9 and whose rear end 16*a* of smaller diameter is engaged in a hole of body 5. The front head 17 of the axial shaft 16 projects to the exterior of body 5 and makes it possible to adjust the axial position of rounded element 13 by rotation of the axial shaft 16, and thus to adjust the tension of spring 12 and to correspondingly adjust the stiffness of the binding. The rounded element 13 is extended at its upper portion by a longitudinal extension 13*a*** whose axial position provides a visual indication of the level of adjustment of the stiffness of the binding.

According to the invention, each of the wings 8 of jaw 7 is journalled around a substantially vertical axis 18 on the rear portion of arm 19 which is substantially in the shape of an L. Each arm 19 is journalled on body 5 at its front portion around an axis 21 adjacent to the apex of the L formed by the arm. Each arm 19 includes a major segment **19*a* which is substantially longitudinal and extends rearwardly, and in the rear portion of which is affixed the journal axis 18 of wing 8, which can thus pivot with respect to arm 19. Arm 19 likewise includes, at its front portion, a minor segment 19*b* which is substantially transverse and extends toward the longitudinal axis xy of the binding. This minor segment 19*b* is in contact with the front surface of the transverse end 9*a* of piston 9**.

Figure 2:
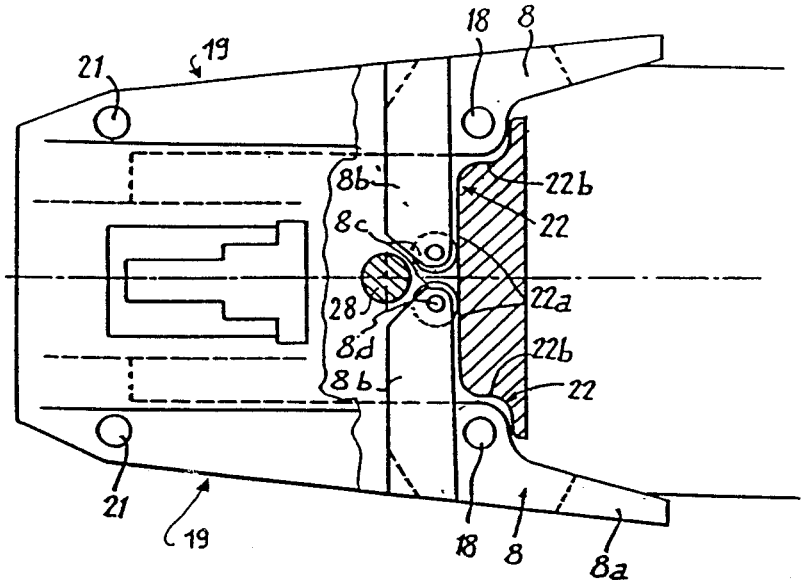
FIG. 2 is a partial horizontal cross-sectional view illustrating the latching apparatus of a lateral retention wing.

As shown in FIG. 2, each wing 8 includes an external branch **8*a* which is inclined from front to rear and from interior to exterior and which ensures both the lateral retention and the vertical retention of the sole of the boot. Wing 8 likewise includes in front of its journal axis 18 a transverse branch 8*b* which extends toward the longitudinal axis xy and which carries at its end a roller 8*c* which is mounted on a substantially vertical axis 8*d* affixed to branch 8*b*. The roller 8*c* is supported on ramp 22 which is affixed to the body of the base. This ramp 22, in front of which is positioned branch 8*b*, includes a section 22*a* which extends transversely, i.e., substantially perpendicularly to the longitudinal axis xy, and which is extended towards the exterior by a curved portion 22*b*** which forms a hook extending towards the rear.

It is seen from the previous description that, as shown in FIGS. 1 and 2, in the engagement position the two lateral and vertical retention wings 8 are maintained in the closed position under the action of piston 9 which is pushed frontwardly by compression spring 12. Piston 9 is in effect applied under pressure against the transverse minor segments 19*b* of the two arms 19 with the result that the longitudinal major segments 19*a* are biased toward the longitudinal axis xy. Consequently, the two wings 8 which are carried by the arms 19 are pressed against the edge of the sole of the ski boot 3. In this closed position the two wings 8 are coupled and effectively form a unitary block with their respective arms 19, by means of the latching apparatus constituted by ramp 22 with transverse section 22*a* of which each arm 8*b* is in contact through its respective roller 8*c*.

Figure 2A:
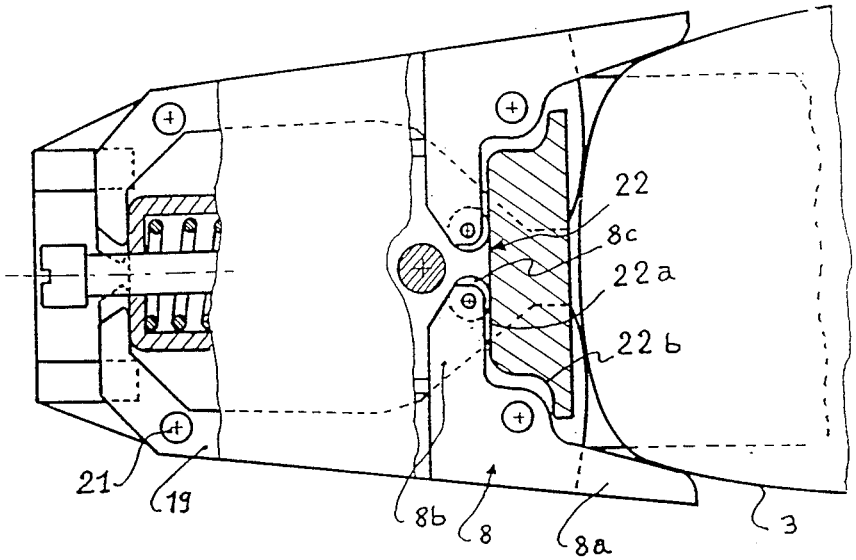
FIGS. 2A, 2B, and 2C are partial horizontal cross-sectional views like that of FIG. 2, illustrating various phases of lateral release of the boot from the binding.
Figure 2B:
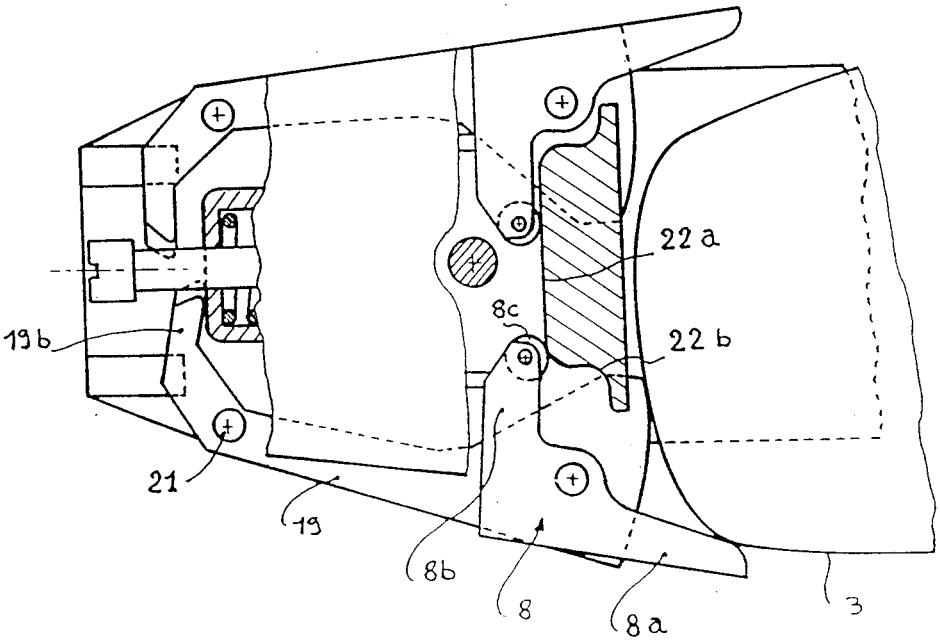
Figure 2C:
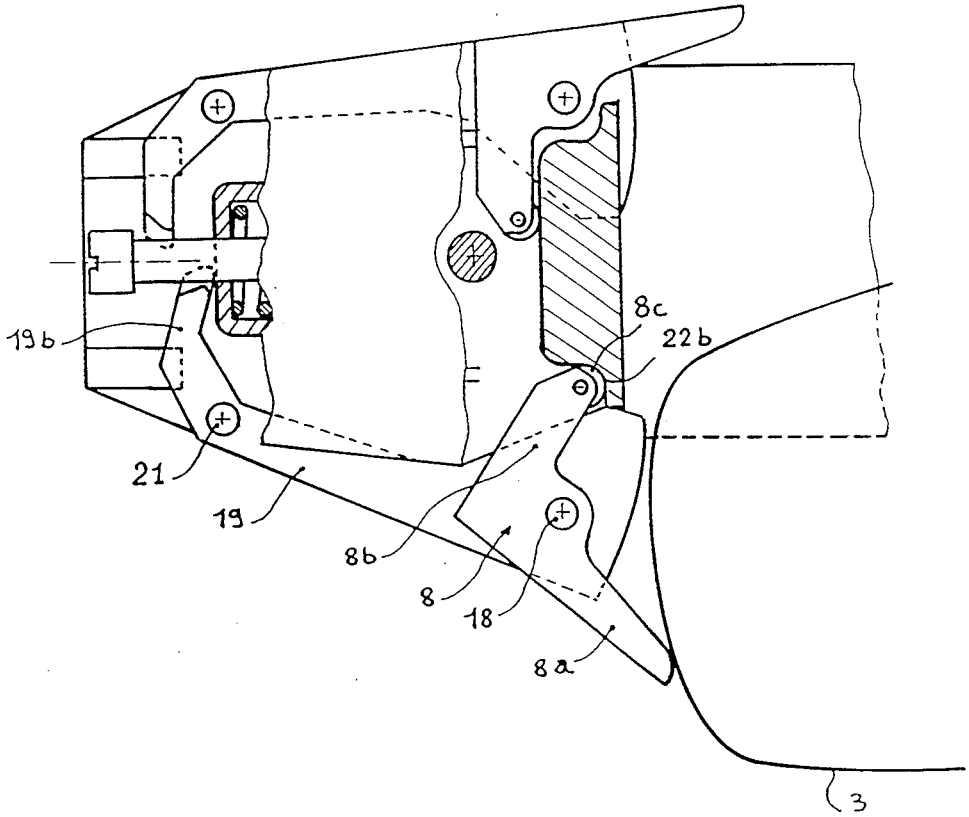

When the leg of the skier is subjected to a torsion, this force translates into a bias through the boot of one of wings 8 towards the exterior. This effective unitary assembly constituted by wing 8 and arm 19, in its closed or engaged position, pivots towards the exterior on body 5 around axis 21 against the action of the compression spring 12, thus pushing piston 9 and, consequently, the minor segments 19*b* of arms 19, rearwardly. This is illustrated in FIGS. 2A and 2B. Wing 8 and arm 19 continue to pivot together towards the exterior until the amplitude of angular movement is sufficient such that roller 8*c* carried by the transverse branch 8*b* of wing 8 engages the curved portion 22*b* of the ramp. At this moment wing 8 is freed since roller 8*c* encounters practically no further resistance to its pivoting movement towards the rear and wing 8*a* can then pivot freely on its arm 19 around axis 18, as shown in FIG. 2C. The disengagement of the boot occurs at this moment.

The curved shape of the portion 22*b* is selected so as to cause a slight additional movement of the arm 19 towards the exterior when wing 8 arrives through its roller 8*c* on this curved-portion. Consequently, the return energy of the arm causes the automatic closure of wing 8 and the return of the arm 19 and of the wing 8 to the engaged position.

As can be seen in FIG. 1, the rear edge 19*c* of the longitudinal segment 19*a* of each arm 19 on which the pivot axis 18 of a wing 8 is mounted constitutes a frontal support for the front of the sole of the boot, this support having, in horizontal cross-section, a curved shape having a convexity directed towards the rear. By virtue of this particular shape of this "enveloping" support 19*c* which is independent of the journalled wing 8, the edge of the sole of the boot practically rolls without sliding and thus without friction on this support, when the boot pivots around its heel. This arrangement does result, however, in a low amount of friction between the sole of the boot and the lateral support furnished by wing 8. One can, however, conceive of support surface shapes such that the friction is negligible on the lateral support and non-negligible on the frontal support 19*c* or even where the friction is divided between the two supports or even reduced further. For example, the surfaces of the wings which engage the sole of the boot could be provided with a certain convexity directed toward the longitudinal axis xy, while still effectively retaining the boot laterally.

Figure 3:
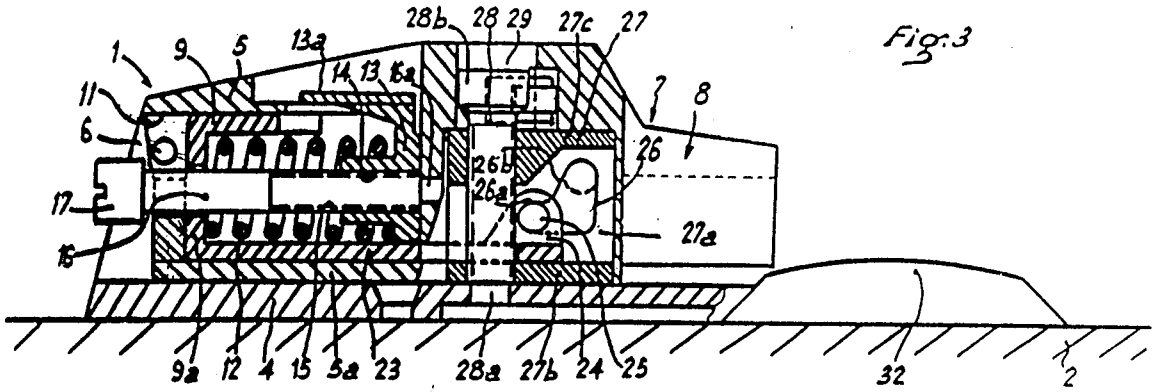
FIG. 3 is a vertical and longitudinal cross-sectional view of the front binding of FIG. 1 in the engaged position.

The front binding according to the invention is likewise provided with means making it possible to soften the stiffness of the binding with respect to lateral bias in the case of a simultaneous rearward fall of the skier. These means include a lower plate 23 which extends piston 9 towards the rear and which is in contact with a lower wall 5*a* of pivoting body 5. This plate 23 ends, at its rear end, in two substantially vertical ears 24 which form, together with plate 23, a cap. Between the two substantially vertical ears 24 there extends a substantially horizontal and transverse pin 25 which projects towards the exterior beyond the two ears 24 and which is engaged, at each end, in slots 26. These slots 26 are provided in the lateral walls 27*a* of a central, generally parallelepipedic hollowed element 27 adapted for the height adjustment of jaw 7 of the front binding. This parallelepipedic element 27 includes a lower horizontal wall 27*b* and an upper horizontal wall 27*c*. It is capped by a corresponding hollowed portion of pivoting body 5. The parallelepipedic element 27 can be adjusted in height by means of a substantially vertically oriented screw 28 which is mounted for rotation, at its lower end 28*a*, in base 4 and which is screwed in coaxial tapped holes in the lower horizontal wall 27*b* and upper horizontal wall 27*c* of the parallelepipedic element 27. The upper head 28*b* of screw 28 is accessible through a hole 29 formed above it in the upper portion of body 5. Consequently, by turning the head 28*b* of screw 28 more or less, it is possible to adjust the height-wise position of the parallelepipedic element 27 with respect to base 4 and, consequently, the height of body 5 and of jaw 7 so as to adapt it to different sole thicknesses. FIG. 3 illustrates element 27 in the lowest position corresponding to a relatively thin sole, and in this position the lower wall 27*b* of element 27 is in contact with the upper surface of base 4. On the other hand, element 27 can be raised and spaced from base 4 such that jaw 7 is adapted for a thicker sole.

Figure 4:
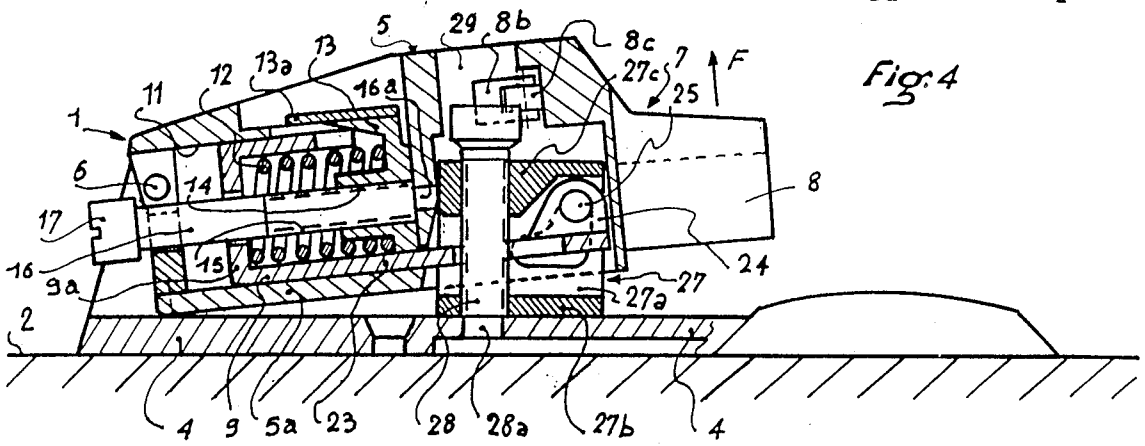
FIG. 4 is a vertical and longitudinal cross-sectional view of the front binding of FIG. 1 whose body is shown pivoted upwardly under the effect of a vertical bias due to a rearward fall of the skier.

As can be seen in FIGS. 3 and 4, each slot 26 has substantially the shape of a right triangle having a substantially horizontal side and a substantially vertical side, and whose hypotenuse forms an inclined ramp from bottom to top and from front to rear. In fact, this ramp includes a short front and lower portion 26*a*, which is substantially horizontal, or slightly inclined towards the top, and a rear portion 26*b* which is longer and steeply inclined from bottom to top and from front to rear. Transverse pin 25 is in contact with this ramp under which it is applied, under the effect of spring 12 pushing piston 9 and, consequently, plate 23 frontwardly.

Consequently, in a purely rearward fall of the skier the pivoting body 5 is maintained substantially vertically by virtue of the fact that pin 25 is supported in the lower horizontal portion 26*a* of the ramp. On the other hand, if the rearward fall is combined with a torsional bias, pin 25 is pushed slightly towards the rear, together with piston 9, under the effect of wing 8 and of arm 19 biased towards the exterior, such that it is no longer vertically retained by horizontal ramp 26*a*. The front of the sole, by being lifted, exerts under the lateral and vertical retention wings 8 a substantially vertical force F (FIG. 4) which causes a pivoting of body 5 relative to base 4 in the counterclockwise direction around the substantially horizontal and transverse axis 6. This movement is possible because the substantially horizontal and transverse pin 25, which accompanies this movement, slides under the inclined ramps 26*b* and, while being lifted it is moved towards the rear a distance equal to the length of the ramps 26*b*. This causes a sliding of plate 23 and of piston 9 towards the rear and, consequently, an additional compression of energy spring 12. As a result, when a rearward fall of the skier is combined with a torsion of the leg, the force to overcome in order to cause the lateral release is less because the spring energy 12 is already partially compressed as a result of the pivoting of body 5 upwardly. A reduction in the stiffness of the front binding relative to a lateral bias is in fact obtained when this lateral bias is combined with a rearward fall.

Figure 5:
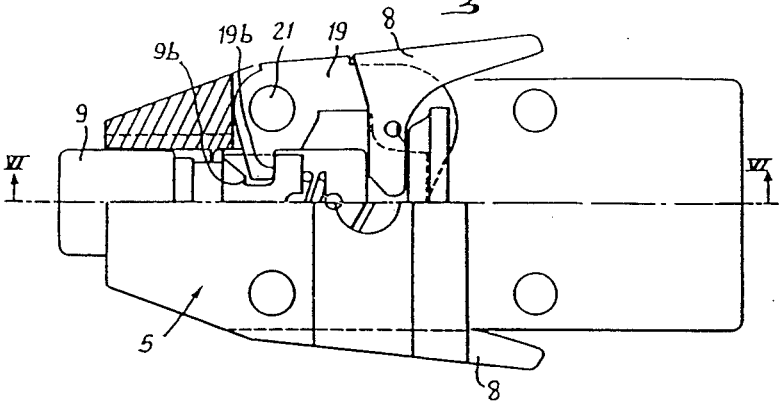
FIG. 5 is a half plan and half horizontal cross-sectional view of an alternative embodiment of the binding according to the invention.
Figure 6:
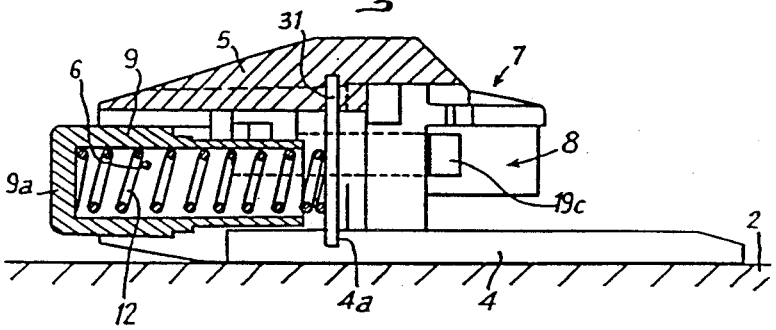
FIG. 6 is a vertical and longitudinal cross-sectional view along line VI—VI of FIG. 5.
Figure 7:
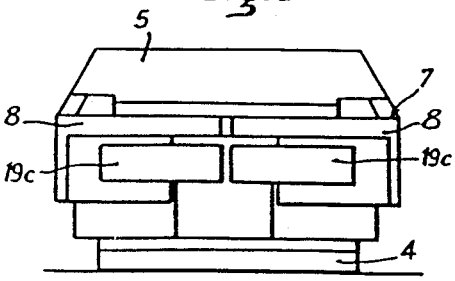
FIG. 7 is a rear view of the front binding of FIGS. 5 and 6.

In the embodiment of the invention shown in FIGS. 1–4, the substantially horizontal and transverse journal axis 6 of pivoting body 5 on base 4 is positioned above the level of the frontal supports 19*c*. Consequently, in the normal position a frontward pressure against the frontal supports 19*c* tends to pivot body 5 in the clockwise direction around axis 6, i.e., towards the ski. This arrangement is not, however, limiting. For example, the body could be arranged to be fixed relative to the ski in which it does not pivot with respect to a base. Further, and alternatively to the embodiment of FIGS. 1–4, the pivot axis 6 of body 5 can likewise be situated substantially at the same level as the frontal supports 19*c*, as is shown in the embodiment of FIGS. 5–7. Further, as shown in dashed lines in FIG. 6, the pivot axis could, alternatively, be positioned below the front supports 19*c*, as indicated by 6'.

In the embodiment of the invention shown in FIGS. 5–7 the front binding includes arms 19 which are shortened with respect to the arms of the embodiment shown in FIGS. 1–4. In this case, the small transverse segment 19*b* of each arm 19 in the shape of an L is engaged in an opening 9*b* provided in the lateral surface of the tubular piston 9, in the vicinity of the rear end of piston 9. The compression spring 12 is supported, as in the embodiment previously described, on the end 9*a* of piston 9 which is in this case totally closed, and at its rear end, it is supported on a substantially vertical fixed pin 31 which extends from base 4 and is affixed in a hole 4*a* formed in the upper surface of the base 4.

In all of the embodiments of the front binding according to the invention wherein the body 5 in mounted to pivot relative to the base 4, the binding can be additionally provided with a pedal 32 (FIG. 1) journalled on the base around a substantially horizontal and transverse axis which forms a frontward fall sensor. This pedal acts, by means of an appropriate transmission mechanism 33 on the energization mechanism in a manner so as to cause, in the case of a frontward fall, a compression of spring 12 by displacement of piston 9 towards the rear.

Although the invention has been described with reference of particular means, materials, and embodiments it is to be understood that the invention is not limited to the particulars disclosed and extends to all equivalents within the scope of the claims.

What is claimed is:

1. A safety binding for releasably retaining the front of a boot mounted on a ski, said binding having a longitudinal axis, said binding comprising:

a body mounted on a base affixed to said ski, a retention jaw movably affixed relative to a rear portion of said body and including a sole-grip and two laterally opposed retention wings, said jaw having an engagement position, an energization mechanism positioned within said body to elastically return said jaw into said engagement position upon movement away from said engagement position, said energization mechanism comprising an energy spring supported, at one end, by a support surface connected to said body, a force transmission element which is longitudinally movable within said body and against which said energy spring is supported at another end of said energy spring, a coupling apparatus which couples said force transmission element and said wings to elastically bias said wings against said front of said boot to ensure the retention of said boot on said ski, said coupling apparatus between said force transmission element and said wings of said jaw comprising two substantially L-shaped arms, each arm comprising a substantially longitudinal major segment extending towards the rear of said binding and which carries, at a rear portion, a respective one of said two lateral retention wings and, in front, a substantially transverse minor segment, extending toward said longitudinal axis of said binding, said L-shaped arms being journalled on said body adjacent portions of respective transverse minor segments of said L-shaped arms which are most remote from said longitudinal axis of said binding, said force transmission element positioned for engagement with respective minor segments to bias said major segment of each arm toward said longitudinal axis of said binding, each major segment of each L-shape arm further comprising a rear edge constituting a frontal support for the front of said sole of said boot, wherein each said lateral retention wing is journalled around said rear portion of said L-shaped arm around a substantially vertical axis, and a latching device operatively associated with each said lateral retention wing to normally maintain each said lateral retention wing in a closed position with its respective L-shaped arm and to free said wing from said closed position only when said L-shaped arm has pivoted by a predetermined angle away from said longitudinal axis of said binding to release said ski boot by lateral pivoting of said wing relative to its respective L-shaped arm.

2. A safety binding according to claim wherein said frontal support of each of said major segments of said L-shaped arms has a convexity directed towards the rear.

3. A safety binding according to claim 1, further comprising a substantially horizontal and transverse journal axis around which said body pivots with respect to said base, wherein said journal axis is positioned above the level of said frontal supports for said sole of said boot.

4. A safety binding according to claim 1, further comprising a substantially horizontal and transverse journal axis around which said body pivots with respect to said base, wherein said journal axis is positioned at substantially the same level as said frontal supports for said sole of said boot.

5. A safety binding according to claim 1, further comprising a substantially horizontal and transverse journal axis around which said body pivots with respect to said base, wherein said journal axis is positioned below the level of said frontal supports for said sole of said boot.

6. A safety binding according to claim 1, wherein each of said wings comprises, in front of its respective journal axis, a transverse branch which includes an end which extends toward said longitudinal axis, each said transverse branch carrying a roller proximate said end, said base further comprising a ramp which is engaged by said rollers, said ramp comprising sections extending transversely from opposite sides of said longitudinal axis to a curved portion extending towards the rear.

7. A safety binding according to claim 6, wherein said rollers of said transverse branches of said wings of said jaw are configured and arranged for engagement with respective curved portions of said ramp for movement therealong away from said longitudinal axis in response to a force against a respective one of said wings to cause at least a respective one of said L-shaped arms to pivot away from said longitudinal axis and for movement of a respective one of said wings relative to its respective L-shaped arm for release of said boot from said binding.

8. A safety binding according to claim 1, wherein said body is pivotably mounted on said base, in a front portion thereof, around a substantially horizontal and transverse axis.

9. A safety binding according to claim 1, further comprising means for reducing a lateral release threshold of said binding in response to a combined upward and lateral movement of said boot.

10. A safety binding according to claim 9, wherein said means for reducing further comprises means for permitting pivoting of said body upwardly about a substantially horizontal and transverse journal axis only in response to a predetermined amount of lateral movement of said boot.

11. A binding for retaining an end of a boot upon a ski, said binding having a longitudinal axis and further comprising:

(a) a body;

(b) means for securing said body to said ski;

(c) a retention jaw for engagement with said end of said boot in an engagement position, said retention jaw comprising:

(i) a first arm and a second arm;

(ii) first means for mounting said first arm and second arm on said body on respective sides of said longitudinal axis for lateral movement with respect to said body;

(iii) a first wing and a second wing; and (iv) second means for mounting said first wing and said wing for lateral movement, respectively, on said first arm and on said second arm, said first wing and said second wing having a closed position in which said first wing and said second wing are substantially fixed for movement with said first arm and said second arm, respectively;

(d) means for elastically biasing said jaw in said engagement position and said wings in said closed position by exerting an elastic force against said first arm and said second arm of said jaw; and (e) means for permitting movement of each of said first wing and said second wing from its respective closed position relative to said first arm and said second arm, respectively, in response to a predetermined amount of movement of said first arm and second arm, respectively, with respect to said body.

12. The binding of claim 11, wherein each of said first arm and said second arm include (i) a segment extending substantially longitudinally and substantially toward said boot from said first mounting means and (ii) a segment extending transversely toward said longitudinal axis from said first mounting means.

13. The binding of claim 12, wherein said first mounting means and said second mounting means pivotably mount said arms and said wings, respectively.

14. The binding of claim 12, wherein said longitudinally extending segments surfaces for longitudinal support of said boot.

15. The binding of claim 11, wherein said means for permitting movement of each of said wings from its respective closed position comprises a guide surface on said body and means affixed to each respective wing for movable engagement with said guide surface.

16. The binding of claim 15, wherein said guide surface of said body comprises a ramp extending substantially transversely, said ramp having a portion extending toward said boot: on either side of said longitudinal axis of said binding, wherein said means affixed to each respective wing comprises a transverse branch movable with respect to said ramp, and wherein each said wing is movable from its respective closed position in response to movement of its respective transverse branch to a respective one of said portions of said ramp.

17. The binding of claim 16, wherein each of said transverse branches carries z: roller for engagement with said ramp.

18. The binding of claim 14, wherein said frontal supports are configured to provide substantially only longitudinal support for said boot and said first wing and said second wing are configured to provide substantially no longitudinal support for said boot.

19. The binding of claim 14, wherein said frontal support of each of said first arm and said second arm have a substantially convex shape directed substantially toward said boot.

20. The binding of claim 11, further comprising means for pivotably mounting said body for movement around a substantially horizontal and transverse axis.

21. The binding of claim 14, further comprising means for pivotably mounting said body for movement around a substantially horizontal and transverse axis, said axis positioned at substantially the same level as said frontal supports.

22. The binding of claim 14, further comprising means for pivotably mounting said body for movement around a substantially horizontal and transverse axis, said axis positioned at substantially the same level as said frontal supports.

23. The binding of claim 14, further comprising means for pivotably mounting said body for movement around a substantially horizontal axis, said axis positioned below said frontal supports.

24. The binding of claim 11, further comprising means for reducing a lateral release threshold, in which said jaw is moved from said engagement position, in response to a combined upward and lateral movement of said boot.

25. The binding of claim 24, wherein said means for reducing further comprises means for permitting pivoting of said body upwardly about a substantially horizontal and transverse journal axis only in response to a predetermined amount of lateral movement of either said first wing or said second wing by said boot.

26. The binding of claim 25, further comprising a first support surface fixed relative to said body and a second support surface movable relative to said body, wherein said elastically biasing means comprises an elastic return element positioned between said first support surface and said second support surface for exerting said elastic force against said transverse segments of said first arm and said second arm of said jaw, wherein said second support surface is movable a predetermined amount, in response to said predetermined amount of lateral movement of said first wing or said second wing by said boot, for permitting said pivoting of said body upwardly about said substantially horizontal and transverse pivot axis.

27. The binding of claim 26, wherein said means for permitting pivoting of said body further comprises a guided element fixed with respect to said body and means for guiding said guided element fixed against movement with said guided element, whereby said means for guiding restrains said guided element for movement upwardly with respect to said means for guiding upon movement of either of said first wing and said second wing less than said predetermined amount.

28. The binding of claim 27, wherein said guided element comprises a substantially horizontally and transversely extending pin and said means for guiding comprises an element having a pair of laterally spaced ears having slots for engagement with said pin.

29. The binding of claim 28, wherein said body is movable upwardly relative to said element, said element adapted to be adjustably affixed to said ski.

30. The binding of claim 29, further comprising means for adjusting the position of said element toward and away from said ski for accommodating various boot sole thicknesses.

31. The binding of claim 11, further comprising a base upon which said body is mounted.

32. The binding of claim 20, further comprising a base upon which said body is mounted which has connected thereto said means for pivotably mounting said body for movement around a substantially horizontal and transverse axis.

33. A binding for retaining an end of a boot upon a ski, said binding having a longitudinal axis and further comprising:

(a) a body;
(b) means for securing said body to said ski;
(c) a retention jaw for engagement with said end of said boot in an engagement position, said retention jaw comprising;
  (i) a first arm and a second arm;
  (ii) first means for mounting said first arm and second arm on said body on respective sides of said longitudinal axis for lateral movement with respect to said body;
  (iii) a first wing and a second wing; and
  (iv) second means for mounting said first wing and said second wing for lateral movement, respectively, on said first arm and on said second arm, said first wing and said second wing having a closed position in which said first wing and said second wing are substantially fixed for movement with said first arm and said second arm, respectively;
(d) means for elastically biasing said jaw in said engagement position and said wings in said closed position by exerting an elastic force against said first arm and said second arm of said jaw; and
(e) a guide surface on said body and means affixed to each respective wing for movable engagement with said guide surface for permitting movement of each of said first wing and said second wing from its respective closed position relative to said first arm and said second arm, respectively, in response to a predetermined amount of movement of said first arm and second arm, respectively, with respect to said body, wherein said guide surface on said body comprises a ramp extending substantially transversely, wherein said ramp has a portion extending toward said boot on either side of said longitudinal axis of said binding, wherein said means affixed to each respective wing comprises a transverse branch moveable with respect to said ramp, and wherein each said wing is movable from its respective closed position in response to movement of its respective transverse branch to a respective one of said portions of said ramp.

34. The binding of claim 33, wherein each of said transverse branches carries a roller for engagement with said ramp.

35. A binding for retaining an end of a boot upon a ski, said binding having a longitudinal axis and further comprising:

(a) a body
(b) means for securing said body to said ski;
(c) a retention jaw for engagement with said end of said boot in an engagement position, said retention jaw comprising:
  (i) a first arm and a second arm;
  (ii) first means for mounting said first arm and second arm on said body on respective sides of said longitudinal axis for lateral movement with respect to said body;
  (iii) a first wing and a second wing; and
  (iv) second means for mounting said first wing and said second wing for lateral movement, respectively, on said first arm and on said second arm, said first wing and said second wing having a closed position in which said first wing and said second wing are substantially fixed for movement with said first arm and said second arm, respectively;
(d) means for elastically biasing said jaw in said engagement position and said wings in said closed position by exerting an elastic force against said first arm and said second arm of said jaw, said binding having a lateral release threshold which is a function of said elastic force exerted by said means for elastically biasing said jaw;
(e) means for permitting movement of each of said first wing and said second wing from its respective closed position relative to said first arm and said second arm, respectively, in response to a predetermined amount of movement of said first arm and second arm, respectively, with respect to said body; and
(f) means for reducing said lateral release threshold, in which said jaw is moved from said engagement position, in response to a combined upward and lateral force exerted by said boot, comprising means for permitting pivoting of said body upwardly about a substantially horizontal and transverse journal axis only in response to a predetermined amount of lateral movement of either of said first wing or said second wing by said boot.

* * * * *

UNITED STATES PATENT AND TRADEMARK OFFICE

CERTIFICATE OF CORRECTION

PATENT NO. : 4,979,762

DATED : December 25, 1990

INVENTOR(S) : Yvon GALLET

It is certified that error appears in the above-identified patent and that said Letters Patent is hereby corrected as shown below:

Column 5, line 2, after "and" start new paragraph beginning ---Fig. 7---.

Column 5, line 13, insert ---,--- after "end".

Column 7, line 35, delete "-" after "curved".

Column 10, line 38 (claim 2, line 1) insert ---1--- after "claim".

Column 11, line 67 (claim 14, line 2), insert ---of said arms comprise respective integral frontal supports having respective--- after "segments".

Column 12, line 17 (claim 17, line 2), change "z:" to ---a---.

Column 12, line 20 (claim 18, line 2), change "are configured to provide" to ---comprise a shape for providing---.

Column 12, line 22 (claim 18, line 4), change "are configured to provide" to ---comprise a shape for providing---.

Column 12, line 35 (claim 21, line 4), change "at substantially the same level as" to ---above---.

Column 12, line 46 (claim 24, line 1), insert ---said binding having a lateral release threshold which is a function of said elastic force exerted by said means for elastically biasing said jaw, said binding--- after "11,".

Column 12, line 47 (claim 24, line 2), change "a" to ---said---.

Column 12, lines 49-50 (claim 24, lines 4/5), change "movement of" to ---force exerted by---.

UNITED STATES PATENT AND TRADEMARK OFFICE

CERTIFICATE OF CORRECTION

PATENT NO. : 4,979,762

DATED : December 25, 1990

INVENTOR(S) : Yvon Gallet

It is certified that error appears in the above-indentified patent and that said Letters Patent is hereby corrected as shown below:

Column 14, line 9 (claim 33, line 41), change "moveable" to ---movable---.

Signed and Sealed this

Twenty-fourth Day of May, 1994

Bruce Lehman

*Attest:*

BRUCE LEHMAN

*Attesting Officer*

*Commissioner of Patents and Trademarks*